US007547840B2

(12) United States Patent
Noh et al.

(10) Patent No.: US 7,547,840 B2
(45) Date of Patent: Jun. 16, 2009

(54) METHOD AND APPARATUS FOR OUTPUTTING AUDIO DATA AND MUSICAL SCORE IMAGE

(75) Inventors: Dong-Hoon Noh, Gumi-si (KR); Joo-Sub Kim, Gumi-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 193 days.

(21) Appl. No.: 11/485,986

(22) Filed: Jul. 14, 2006

(65) Prior Publication Data

US 2007/0012165 A1 Jan. 18, 2007

(30) Foreign Application Priority Data

Jul. 18, 2005 (KR) ..... 10-2005-0064712
Jun. 7, 2006 (KR) ..... 10-2006-0051072

(51) Int. Cl.
*G10H 7/00* (2006.01)

(52) U.S. Cl. ..... 84/601; 84/600

(58) Field of Classification Search ..... 84/600–603
See application file for complete search history.

(56) References Cited

U.S. PATENT DOCUMENTS 4,457,203 A * 7/1984 Schoenberg et al. ..... 84/454
4,463,650 A * 8/1984 Rupert ..... 84/654
4,479,416 A * 10/1984 Clague ..... 84/462
4,633,748 A * 1/1987 Takashima et al. ..... 84/603
5,038,658 A * 8/1991 Tsuruta et al. ..... 84/461
5,202,528 A * 4/1993 Iwaooji ..... 84/616
5,210,366 A * 5/1993 Sykes, Jr. ..... 84/616
5,357,045 A * 10/1994 Tabei ..... 84/603
5,942,709 A * 8/1999 Szalay ..... 84/616
5,986,199 A * 11/1999 Peevers ..... 84/603
6,140,568 A * 10/2000 Kohler ..... 84/616
6,355,869 B1 * 3/2002 Mitton ..... 84/603
6,392,132 B2 * 5/2002 Uehara ..... 84/477 R
6,541,691 B2 * 4/2003 Tolonen et al. ..... 84/616
6,664,458 B2 * 12/2003 Hiratsuka et al. ..... 84/477 R
6,725,108 B1 * 4/2004 Hall ..... 700/94
6,787,689 B1 * 9/2004 Chen ..... 84/600
6,856,923 B2 * 2/2005 Jung ..... 702/71
6,930,236 B2 * 8/2005 Jung ..... 84/616
7,149,682 B2 * 12/2006 Yoshioka et al. ..... 704/205
7,202,407 B2 * 4/2007 Kawashima et al. ..... 84/609
7,323,629 B2 * 1/2008 Somani et al. ..... 84/470 R
2001/0036620 A1 * 11/2001 Peer et al. ..... 434/307 R (Continued)

*Primary Examiner*—David S. Warren
(74) *Attorney, Agent, or Firm*—Roylance, Abrams, Berdo & Goodman, L.L.P.

(57) ABSTRACT

A method and apparatus for outputting audio data and a musical score image, displaying a musical score image corresponding to reproduced audio data, and outputting audio data corresponding to a musical score image are provided, in which a tone is extracted, the tone is converted into a frequency, a monotone or polyphonic tone is identified, the frequency corresponding to a monotone or polyphonic tone is converted into tone information data, and the tone information data is stored, and a musical score is displayed. Also, audio data corresponding to a musical score are output, in which the musical score is photographed, musical signs from the photographed musical score are extracted, a pitch of a tone is extracted from music paper and musical note information of the musical signs, a duration of the tone from the musical note information of the musical signs is extracted, and audio data are output.

21 Claims, 3 Drawing Sheets

U.S. PATENT DOCUMENTS

2001/0044721 A1* 11/2001 Yoshioka et al. ..... 704/258
2003/0061047 A1* 3/2003 Yoshioka et al. ..... 704/258
2004/0193429 A1* 9/2004 Kimoto ..... 704/278
2004/0200337 A1* 10/2004 Abe et al. ..... 84/616
2005/0005760 A1* 1/2005 Hull et al. ..... 84/645
2005/0244019 A1* 11/2005 Lallemand ..... 381/94.3
2006/0112812 A1* 6/2006 Venkataraman et al. ..... 84/616
2007/0127726 A1* 6/2007 Ellis et al. ..... 381/15

* cited by examiner

METHOD AND APPARATUS FOR OUTPUTTING AUDIO DATA AND MUSICAL SCORE IMAGE

PRIORITY

This application claims the benefit under 35 U.S.C. 119(a) of Korean Patent Applications filed in the Korean Intellectual Property Office on Jul. 18, 2005 and assigned Serial No. 2005-64712, and filed on Jun. 7, 2006 and assigned Serial No. 2006-51072, the entire disclosure of both of which are hereby incorporated by reference.

BACKGROUND OF THE INVENTION

1. Field of the Invention

The present invention relates to a method and apparatus for outputting audio data and a musical score image. More particularly, the present invention relates to a method and apparatus for displaying a musical score image corresponding to reproduced audio data and outputting audio data corresponding to a musical score image.

2. Description of the Related Art

Currently, a mobile terminal provides various supplementary service functions in addition to a communication service function. Particularly, a MP3 play function of the mobile terminal enables a user to enjoy MP3 audio reproduced through the mobile terminal, even though the user does not carry a separate MP3 player.

If the mobile terminal can display a musical score corresponding to MP3 audio data while reproducing the MP3 audio data, it will be possible to provide the user of the mobile terminal with an interesting service that visually displays musical tones.

Meanwhile, the mobile terminal has a music composition function of outputting audio data composed by the user.

However, a conventional melody composition function comprises problems which require the user to perform cumbersome work and the mobile terminal consumes a large amount of battery power. According to a procedure for executing the conventional melody composition function, the user of the mobile terminal must manually input all musical notes on a music paper. In this case, a pitch of each tone is set by using up and down buttons based on the tone of "Do". Therefore, when the user desires to input a tone having a large difference from the basic tone "Do", the user must press the up or down button several times in order to input just one tone, which causes considerable inconvenience to users and requires a significant amount of time.

Also, a significant amount of work is required when the user sets a duration of a tone, because the user must activate a pop-up window and select a desired duration for the tone from the pop-up window.

For these reasons, composing music by using an actual mobile terminal requires a significant amount of time and a user's frequent handling of the buttons, which may give inconvenience to the user. In addition, a large load is imposed on the mobile terminal itself, thereby rapidly consuming the battery power of the mobile terminal.

Accordingly, there is a need for an improved method and apparatus for composing music by outputting audio data and a musical score image in a mobile terminal.

SUMMARY OF THE INVENTION

An aspect of exemplary embodiments of the present invention is to address at least the above problems and/or disadvantages and to provide at least the advantages described below. Accordingly, an aspect of exemplary embodiments of the present invention is to provide a method and apparatus for outputting audio data and a musical score image, which can display a musical score image corresponding to reproduced audio data and output audio data corresponding to a musical score image, and allow editing of a displayed musical score.

To accomplish the object, in accordance with one aspect of exemplary embodiments of the present invention, there is provided a method and apparatus for outputting a musical score corresponding to audio data, in which a tone is extracted by removing words from the audio data while the audio data are being reproduced; the tone is converted into a frequency; the frequency is converted into tone information data by analyzing the frequency, and the tone information data is stored; a musical score corresponding to the tone information data is displayed; a mode shift into a musical score editing mode is performed when editing is selected while the musical score is being displayed; a pitch of a tone for a corresponding musical note within the musical score is adjusted in the musical score editing mode; a duration of a tone for a corresponding musical note is changed within the musical score in the musical score editing mode; a corresponding musical note is changed to a selected musical note within the musical score in the musical score editing mode; and a supplementary function for musical score editing is performed in the musical score editing mode.

In accordance with another aspect of exemplary embodiments of the present invention, there is provided a method and apparatus for outputting a musical score corresponding to audio data, in which a tone is extracted by removing words from the audio data while the audio data are being reproduced; the tone is converted into a frequency; a monotone or polyphonic tone is identified by analyzing the frequency extracted during a predetermined time period, after the predetermined time period elapses; the frequency corresponding to a monotone or polyphonic tone is converted into tone information data, and storing the tone information data; a musical score is displayed by extracting a musical sign corresponding to the tone information data; a mode shift into a musical score editing mode is performed when editing is selected while the musical score is being displayed; a pitch of a tone for a corresponding musical note within the musical score is adjusted in the musical score editing mode; a duration of a tone for a corresponding musical note is changed within the musical score in the musical score editing mode; a corresponding musical note is changed to a selected musical note within the musical score in the musical score editing mode; and a supplementary function for musical score editing is performed in the musical score editing mode.

In accordance with still another aspect of exemplary embodiments of the present invention, there is provided a method and apparatus for outputting audio data corresponding to a musical score, in which the musical score is photographed; musical signs from the photographed musical score are extracted; a pitch of a tone from music paper and musical note information of the musical signs are extracted; a duration of the tone is extracted from the musical note information of the musical signs; audio data are output by using the extracted tone's pitch and duration.

In accordance with a further aspect of exemplary embodiments of the present invention, there is provided a computer-readable recording medium storing a computer program code for performing a method for outputting a musical score corresponding to audio data, in which a tone is extracted by removing words from the audio data while the audio data are being reproduced; the tone is converted into a frequency; the frequency is converted into tone information data by analyzing the frequency, and the tone information data is stored; and a musical score corresponding to the tone information data is displayed.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, features and advantages of certain exemplary embodiments of the present invention will be more apparent from the following detailed description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of exemplary embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
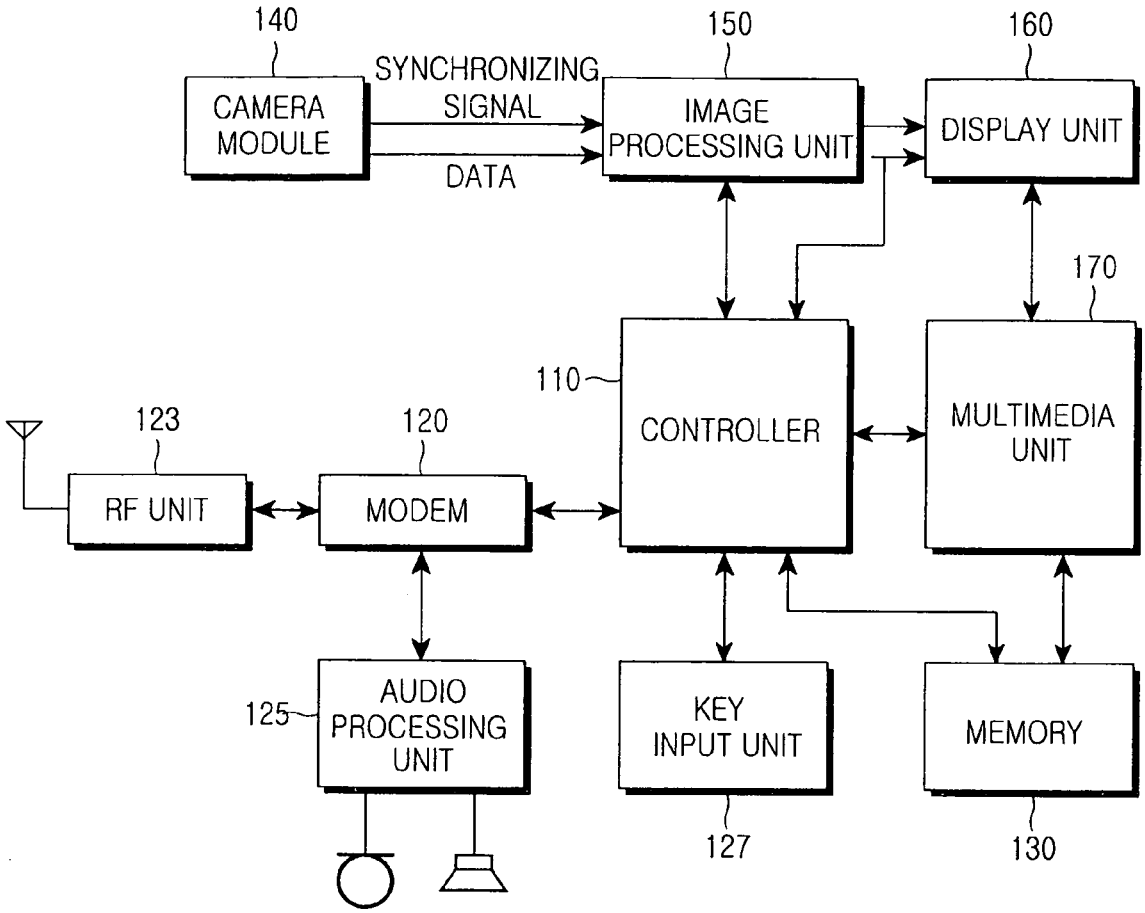
FIG. 1 is a block diagram illustrating the construction of a mobile terminal according to an exemplary embodiment of the present invention.

FIG. 1 is a block diagram illustrating the construction of a mobile terminal including a camera according to an exemplary embodiment of the present invention.

A radio frequency (RF) unit 123 performs a wireless communication function of the mobile terminal. The RF unit 123 includes an RF transmitter and an RF receiver, in which the RF transmitter up-converts and amplifies the frequency of a signal to be transmitted, and the RF receiver low-noise amplifies a received signal and down-converts the frequency of the received signal. A modem 120 includes a transmitter for encoding and modulating the signal to be transmitted and a receiver for demodulating and decoding the received signal. An audio processing unit 125 may include a codec, which contains a data codec for processing packet data and the like, and an audio codec for processing an audio signal such as a voice. The audio processing unit 125 converts a digital audio signal received from the modem 120 into an analog signal using the audio codec, thereby reproducing the converted analog signal. Also, the audio processing unit 125 converts an analog audio signal for transmission generated from a microphone into a digital audio signal using the audio codec, and transmits the converted digital audio signal to the modem 120. The codec may be separately constructed, or may be included in a controller 110.

A memory 130 may include a program memory and a data memory. The program memory may store programs for controlling general operations of the mobile terminal.

Also, according to an exemplary embodiment of the present invention, the memory 130 may store a control program for converting audio data into frequencies, a control program for analyzing the frequencies and extracting tone information data from the frequencies, and a control program for extracting musical signs corresponding to the tone information data and displaying a musical score image. In addition, the memory 130 stores a database for images of musical signs so that musical signs corresponding to the tone information data can be extracted.

Also, according to an exemplary embodiment of the present invention, the memory 130 may store a control program for recognizing musical sign images in a photographed musical score and outputting audio data corresponding to the musical sign images. In addition, the memory 130 stores a database for audio data which have audio data values corresponding to the musical sign images.

The data memory temporarily stores data generated while the programs are being executed.

The controller 110 controls an entire operation of the mobile terminal. The controller 110 may include the modem 120 and the codec.

According to an exemplary embodiment of the present invention, the controller 110 also controls a musical score image corresponding to reproduced audio data to be displayed. In addition, the controller 110 provides an editing function for the displayed musical score image. Also, the controller 110 controls audio data corresponding to the photographed musical score image to be output.

The operations of displaying a musical score image corresponding to audio data and outputting audio data corresponding to a musical score image, according to an exemplary embodiment of the present invention, may be performed by a multimedia unit 170 under the control of the controller 110. However, the following exemplary embodiment of the present invention will be given on the assumption that the operations of displaying a musical score image corresponding to audio data and outputting audio data corresponding to a musical score image are controlled and performed by the controller 110.

The multimedia unit 170 performs supplementary service functions, such as camera photographing, MP3 data output, and the like, which are provided by the mobile terminal, under the control of the controller 110. Also, according to an exemplary embodiment of the present invention, the multimedia unit 170 displays a musical score image corresponding to audio data and outputs audio data corresponding to a musical score image under the control of the controller 110. The function of the multimedia unit 170 according to an exemplary embodiment of the present invention may be controlled and performed by the controller 110

A camera module 140 photographs an image, and includes a camera sensor and a signal processing section. The camera sensor converts an optical signal obtained through the photographing into an electric signal, and the signal processing section converts an analog image signal obtained through the photographing of the camera sensor into digital data. In an exemplary implementation, it is assumed that the camera sensor is a charged coupled device (CCD) sensor, and the signal processing section may include a digital signal processor (DSP). Also, the camera sensor and the signal processing section may be integrally or separately constructed. According to an exemplary embodiment of the present invention, the camera module 140 also photographs a musical score in a musical score recognition mode.

An image processing unit 150 performs a function to generate image data for displaying an image signal output from the camera module 140. The image processing unit 150 processes an image signal, which is output from the camera module 140, in a unit of frame, and outputs the frame image data to be suitable for the screen size and the properties of a display unit 160. Also, the image processing unit 150 includes a video codec to compress frame image data displayed on the display unit 160 by using a predetermined scheme and restore original frame image data from compressed frame image data. In an exemplary implementation, the video codec may include a Joint Photographic Experts Group (JPEG) codec, a Moving Picture Experts Group 4 (MPEG4) codec, a Wavelet codec, and the like. It is assumed that the image processing unit 150 has an On Screen Display (OSD) function and can output OSD data according to the size of a display screen under the control of the controller 110. According to an exemplary embodiment of the present invention, the image processing unit 150 also decodes a musical score image, which is stored after being photographed by the camera module 140 in the musical score recognition mode, and converts the decoded musical score image into a black-and-white image.

The display unit 160 displays on a screen an image signal output from the image processing unit 150 and user data output from the controller 110. In an exemplary implementation, the display unit 160 may employ a liquid crystal display (LCD). When the LCD is employed, the display unit 160 may include an LCD controller, a memory for storing image data, an LCD display element, and the like. In an exemplary implementation, when the LCD is implemented in a touch screen scheme, the display unit 160 may serve as an input section. Also, the display unit 160 may display a musical score image corresponding to audio data being reproduced.

A key input unit 127 includes keys for inputting numeral and character information and function keys for setting various functions. In an exemplary implementation, the key input unit 127 may include a specific function key for displaying a musical score image corresponding to audio data being reproduced. In addition, the key input unit 127 may include a specific function key for outputting audio data corresponding to a musical score image.

The operations of displaying a musical score image corresponding to audio data and outputting audio data corresponding to a musical score image in the mobile terminal will be described below with reference to FIGS. 2 and 3.

Figure 2:
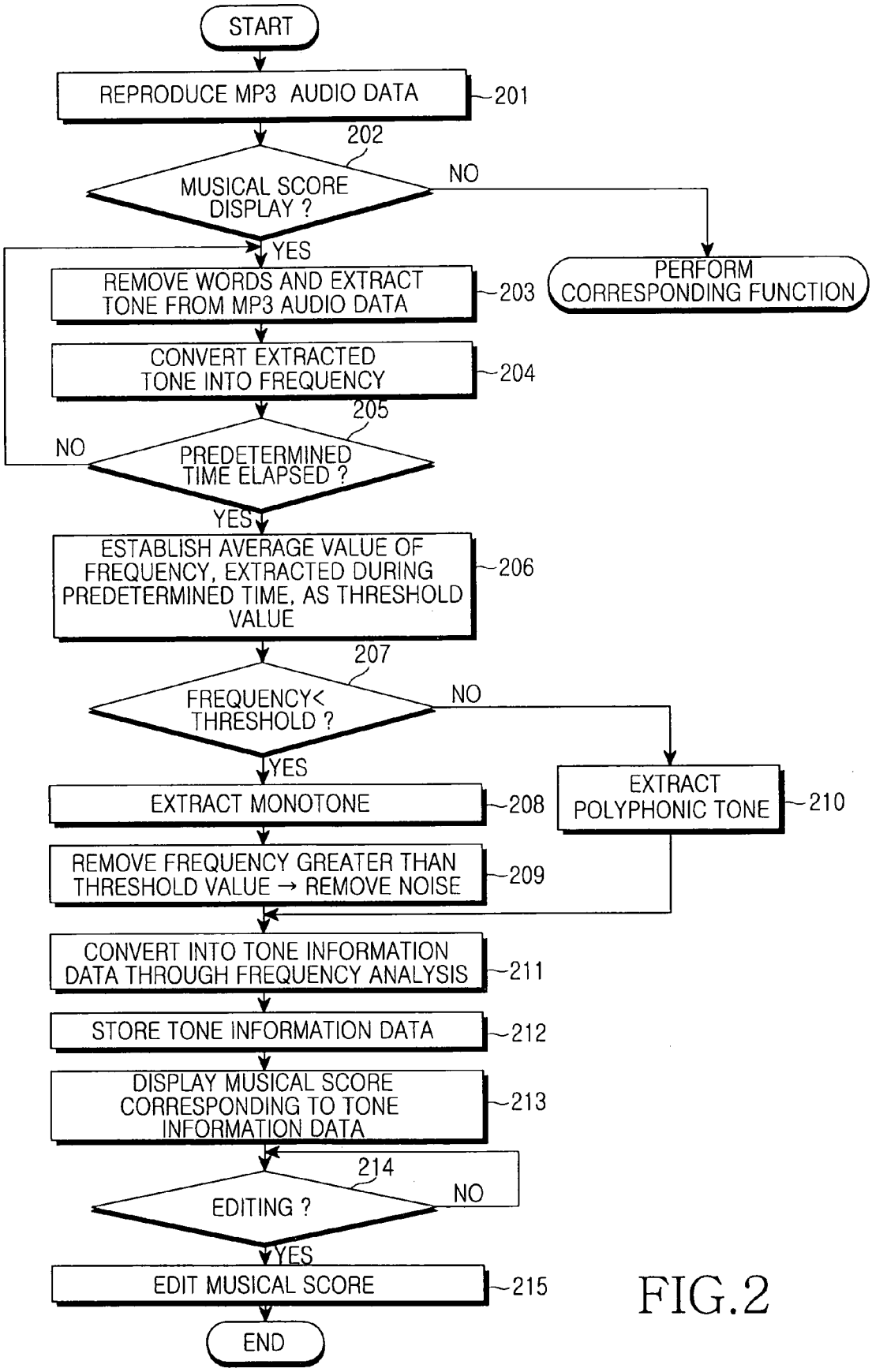
FIG. 2 is a flowchart illustrating a method for extracting a musical score image from audio data in the mobile terminal according to an exemplary embodiment of the present invention.

FIG. 2 is a flowchart illustrating a method for extracting a musical score image from audio data in the mobile terminal according to an exemplary embodiment of the present invention.

Hereinafter, certain exemplary embodiments of the present invention, as shown in FIG. 2, will be described in detail with reference to FIG. 1.

When musical score representation is selected in step 201, in which MP3 audio data are being output, the controller 110 in the mobile terminal senses the selection in step 202 and proceeds to step 203.

In step 203, the controller 110 removes words from the MP3 audio data being reproduced by filtering the MP3 audio data, thereby extracting only tones of the MP3 audio data. Then, the controller 110 converts the tones, which have been extracted in step 203, from an analog signal into a digital signal through quantization and pulse code modulation (PCM), and converts the digitalized tones into frequencies through a fast Fourier transform (FFT) (step 204).

In the course of repeatedly performing steps 203 and 204, when a predetermined time period has elapsed, the controller 110 senses the elapse in step 205 and proceeds to step 206. In step 206, the controller 110 calculates an average value of frequency values extracted during the predetermined time period and sets the average value as a threshold value. In an exemplary implementation, the predetermined time period may have a length determined by a second.

Then, the controller 110 compares each frequency value extracted during the predetermined time period with the threshold value set in step 206. When a frequency value extracted during the predetermined time period is less than the threshold value, the controller 110 senses the value in step 207 and determines the frequency value, which is less than the threshold value, as a monotone (step 208). In step 209, the controller 110 removes noise by removing a frequency value, which is equal to or greater than a threshold value, from among the frequency values determined as a monotone in step 208.

After step 209, the controller 110 proceeds to step 211, in which the controller 110 analyzes the frequency, from which noise has been removed in step 209, to convert the frequency into its corresponding tone information data. That is, in step 211, the controller 110 analyzes the frequency determined as a monotone, and converts the frequency into tone information data including musical sign information, which contains musical note information based on pitch and duration of a tone, and incidental musical sign information other than the musical note information.

In step 212, the controller 110 stores the tone information data obtained in step 211 in the memory 130. In step 213, the controller 110 extracts a musical sign corresponding to the tone information data from the musical sign image database stored in the memory 130, and displays the extracted musical sign through the display unit 160.

In contrast, when a frequency value extracted during the predetermined time period is equal to or greater than the threshold value, the controller 110 senses the value in step 207 and determines the frequency value, which is equal to or greater than the threshold value, as a polyphonic tone (step 210).

After step 210, the controller 110 proceeds to step 211, in which the controller 110 analyzes the frequency determined as a polyphonic tone in step 210 to convert the frequency into its corresponding tone information data. That is, in step 211, the controller 110 analyzes the frequency determined as a polyphonic tone, and converts the frequency into tone information data including musical sign information, which contains musical note information based on the pitch and duration of a tone, and incidental musical sign information other than the musical note information.

In step 212, the controller 110 stores the tone information data obtained in step 211 in the memory 130. In step 213, the controller 110 extracts a musical sign corresponding to the tone information data from the musical sign image database stored in the memory 130, and displays the extracted musical sign on the display unit 160.

While repeating steps 203 to 213, the controller 110 controls a musical score image corresponding to MP3 audio data, which are being reproduced in step 201, to be displayed on the display unit 160.

In addition, the musical score image displayed through steps 203 to 213 may be edited through a musical score editing process.

According to the musical score editing process, in a state in which the musical score image is displayed on the display unit 160, when a musical score editing menu is selected, the controller 110 senses the selection in step 214 and shifts the mobile terminal into a musical score editing mode in step 215.

In the musical score editing mode, the controller 110 displays a musical note selection box cursor for musical score editing such that the box cursor selects and indicates a corresponding musical note, for example the first displayed musical note, in the musical score image. The musical note selection box cursor can select and indicate a corresponding musical note while moving according to an input of left and right directional keys. Also, the musical note selection box cursor can be positioned in order to indicate a musical note, an incidental musical sign other than musical notes, or an empty space, while moving in a predetermined interval unit in a music paper.

When the signal of an up directional key is input in the musical score editing mode, the controller 110 senses the input and raises the musical note, which has been selected by the musical box selection box cursor, according to the input of the up directional key on the music paper. When the signal of a down directional key is input in the musical score editing mode, the controller 10 senses the input and lowers the musical note, which has been selected by the musical box selection box cursor, according to the input of the down directional key on the music paper.

In addition, when a tone pitch menu is selected in the musical score editing mode, the controller 110 senses the selection and displays types of tone pitches, which include tone-pitch-related signs. When a flat sign "b" is selected from the tone-pitch-related signs, the controller 110 senses the selection and lowers the pitch of a musical note, which has been selected by the musical box selection box cursor, by one half step. Similarly, when a sharp sign "#" is selected from the tone-pitch-related signs, the controller 110 senses the selection and raises the pitch of a musical note, which has been selected by the musical box selection box cursor, by one half step.

Also, when a musical note menu is selected in the musical score editing mode, the controller 110 senses the selection and displays various musical notes. When a musical note is selected from among the displayed musical notes, the controller 110 senses the selection, and the controller 110 either changes a musical note indicated by the musical box selection box cursor into the selected musical note, or inserts the selected musical note into an empty space indicated by the musical box selection box cursor.

Also, when an incidental musical sign menu is selected in the musical score editing mode, the controller 110 senses the selection and displays incidental musical signs of every kind. When an incidental musical sign is selected from among the displayed incidental musical signs, the controller 110 senses the selection, and the controller 110 either changes an incidental musical sign indicated by the musical box selection box cursor into the selected incidental musical sign, or inserts the selected incidental musical sign into an empty space indicated by the musical box selection box cursor.

Also, when a supplementary function is selected in the musical score editing mode, the controller 110 senses the selection and displays supplementary function items for musical score editing. The supplementary function items for musical score editing include block setup, copy, cut, pastes, delete, and reproduction items.

The block setup function is used to select musical notes and incidental musical signs which are displayed in a determined area within the displayed musical score image. The copy function is used to copy individual or multiple musical notes and/or incidental musical signs, which have been selected by the block setup function or by the musical box selection box cursor. The cut function is used to cut individual or multiple musical notes and/or incidental musical signs, which have been selected by the block setup function or by the musical box selection box cursor. The paste function is used to paste the musical notes and/or incidental musical signs, which have been selected by the copy or cut function, on a predetermined position selected by the block setup function or by the musical box selection box cursor in the music paper. The delete function is used to delete individual or multiple musical notes and/or incidental musical signs, which have been selected by the block setup function or by the musical box selection box cursor, and the reproduction function is used to reproduce a musical score displayed in the musical score editing mode.

Figure 3:
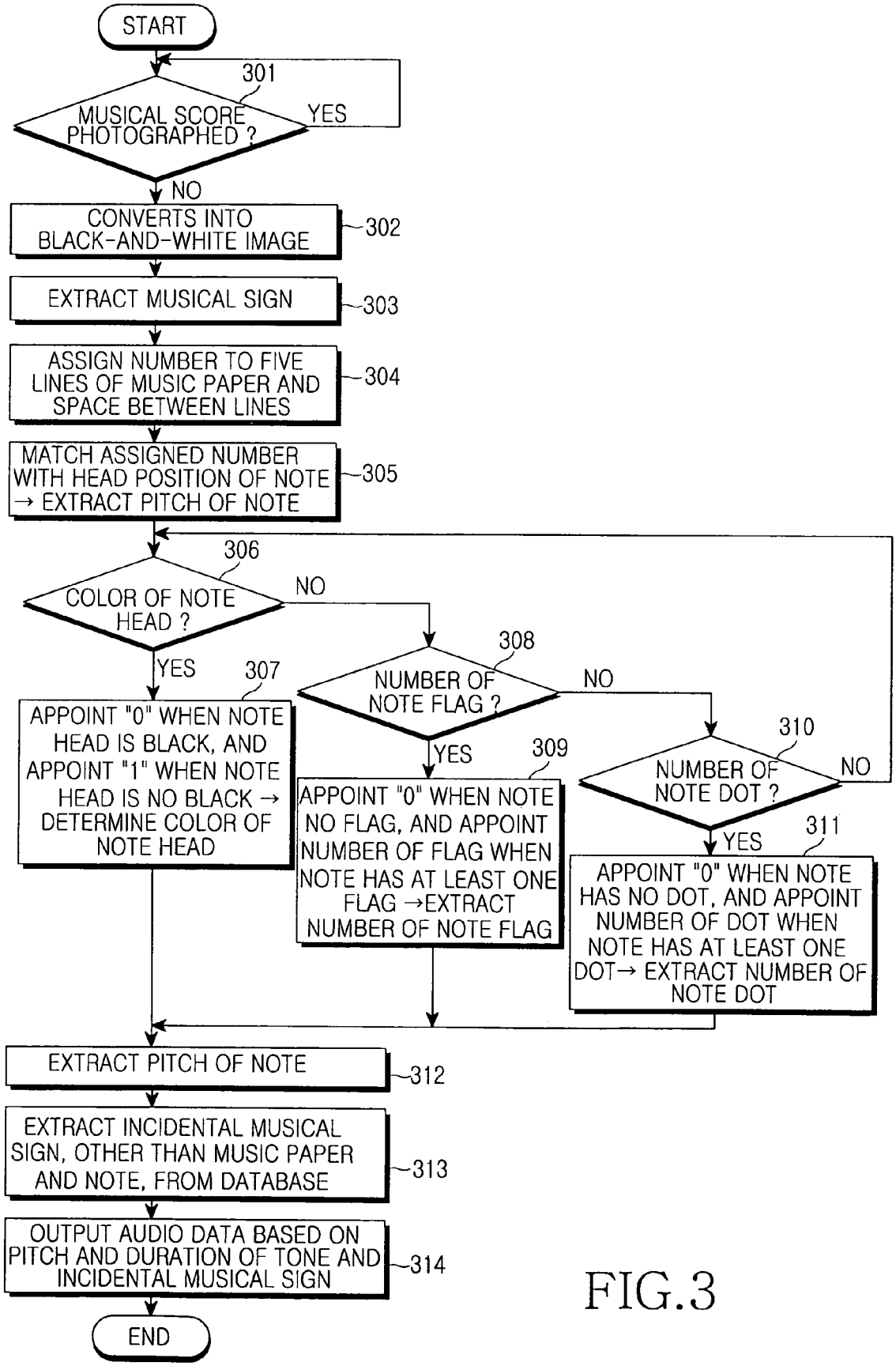
FIG. 3 is a flowchart illustrating a procedure for extracting audio data from a musical score image and outputting the extracted audio data in the mobile terminal according to an exemplary embodiment of the present invention.

FIG. 3 is a flowchart illustrating a procedure for extracting audio data from a musical score image and outputting the extracted audio data in the mobile terminal according to an exemplary embodiment of the present invention.

Hereinafter, certain exemplary embodiments of the present invention, as shown in FIG. 3, will be described below in detail with reference to FIG. 1.

When a musical score image is photographed through the camera module 140 in the musical score recognition mode of the mobile terminal, the controller 110 senses the photographed musical score image in step 301 and stores the photographed musical score image in the memory 130. In step 302, the controller 110 controls the image processing unit 150 such that the image processing unit 150 decodes the musical score image stored in the memory 130, and converts the decoded musical score image into a black-and-white image.

In step 303, the controller 110 extracts musical signs from the musical score image converted into the black-and-white image. Then, the controller 110 first extracts five lines of a music paper and assigns numbers to the five lines of the music paper and every space between the lines (step 304).

That is, in step 304, the controller 110 sequentially assigns numbers 1, 3, 5, 7, and 9 to the five lines of the music paper beginning at the lowest line thereof. Also, the controller 110 assigns number 0 to the space below the number 1 line, number 2 to the space between the numbers 1 and 3 lines, number 4 to the space between the numbers 3 and 5 lines, number 6 to the space between the numbers 5 and 7 lines, number 8 to the space between the numbers 7 and 9 lines, and number 10 to the space above the number 9 line.

After assigning numbers to the five lines of the music paper and spaces between the lines in step 304, the controller 110 extracts musical note information from the musical signs extracted in step 303 and obtains a numerical value corresponding to the pitch by matching the position of the head of a musical note in the musical note information with the numbers assigned to the music paper (step 305).

In detail, in step 305, the controller 110 determines if the position of the head of the musical note is located in the number 0 or 10 space. When the position of the head of the musical note is not located in the number 0 space or in the number 10 space, the controller 110 senses the located and extracts a number in the music paper, which corresponds to the position of the head of the musical note, thereby obtaining a numerical value corresponding to the pitch of the tone. For example, when the head of the musical note is positioned in the number 2 space, the controller 110 can extract a tone of "Fa".

In contrast, when the position of the head of the musical note is located in the number 0 or 10 space, the controller 110 senses the location, and obtains a numerical value corresponding to the pitch in consideration of the number of note heads which may be located between the note head and the number 1 or number 9 line.

After extracting the pitch value of the tone in step 305, the controller 110 extracts the duration value of the tone. In order to obtain the duration value of the tone, the controller 110 extracts the color of the head of the musical note, the number of flags thereof, and the number of dots thereof from the musical note information.

In step 306, in order to obtain a value for the head color of the musical note, the controller 110 determines the head color of the musical note. In step 307, the controller 110 appoints "0" for the color of the note head when the note head is filled with black, and appoints "1" for the color of the note head when the note head is not filled with black, thereby obtaining a numerical value corresponding to the head color of the musical note.

In step 308, in order to obtain a value for the number of flags of the musical note, the controller 110 extracts the number of note flags. In step 309, the controller 110 appoints "0" for the number of note flags when the musical note has no flag, and appoints a corresponding number when the musical note has one or more flags, thereby obtaining a numerical value corresponding to the number of note flags.

In step 310, in order to obtain a value for the number of dots of the musical note, the controller 110 extracts the number of note dots. In step 311, the controller 110 appoints "0" for the number of note dots when the musical note has no dot, and appoints a corresponding number for the number of note dots when the musical note has one or more dots, thereby obtaining a numerical value corresponding to the number of note dots.

After steps 307, 309, and 311, the controller 110 extracts the duration value of the tone in step 312.

After extracting the pitch and duration of the tone in steps 305 and 312, the controller 110 extracts incidental musical signs, other than the music paper and the musical note information, from the musical sign information, and extracts numerical values corresponding to the incidental musical signs through a corresponding database (step 313).

In step 314, the controller 110 extracts and outputs an audio data value, which corresponds to the numerical values for the tone's pitch and duration extracted steps 305 and 312 and the numerical values for the incidental musical signs extracted in step 313, from the database for audio data stored in the memory 130.

The invention can also be embodied as computer readable code on a computer readable recording medium. A computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion. Also, functional programs, code, and code segments for accomplishing the present invention can be easily construed by programmers skilled in the art to which the present invention pertains.

As described above, the exemplary embodiments of the present invention provides a method for displaying a musical score image corresponding to audio data and outputting audio data corresponding to a musical score image. Therefore, the exemplary embodiments of the present invention can provide entertainment by which a user can draw corresponding musical score after listening to a piece of music or musical instrument's sound, and can recognize a musical score and output audio data corresponding to the musical score.

While the present invention has been shown and described with reference to certain exemplary embodiments thereof, it will be understood by those skilled in the art that various changes in form and details may be made therein without departing from the spirit and scope of the invention as defined by the appended claims and the equivalents thereof.

What is claimed is:

1. A method for outputting a musical score corresponding to audio data, the method comprising:

removing words from audio data and extracting a tone from the wordless audio data while the audio data is being reproduced;

converting the tone into a frequency;

calculating an average value of frequencies extracted during a time period and establishing the average value as a threshold value;

identifying a frequency less than the threshold value as a monotone and converting the corresponding frequency into tone information data;

identifying a frequency equal to or greater than the threshold value as a polyphonic tone and converting the corresponding frequency into tone information data; and displaying a musical score corresponding to the tone information data.

2. The method as claimed in claim 1, wherein the extracting of a tone and the converting of the tone are performed at a time interval.

3. The method as claimed in claim 1, wherein the converting of the tone comprises:

quantizing the tone, from which the words have been removed;

extracting pulse code modulation (PCM) data from the quantized data; and converting the PCM data into a frequency through fast Fourier transform (FFT).

4. The method as claimed in claim 1, further comprising removing noise when the corresponding frequency has been identified as the monotone, by determining a frequency signal equal to or greater than the threshold value to be noise.

5. The method as claimed in claim 1, wherein the displayed musical score includes extracted musical signs corresponding to the tone information data.

6. The method as claimed in claim 1, wherein the tone information data include musical sign information, which comprises musical note information including a pitch of a tone and a duration of the tone, and incidental musical sign information other than the musical note information.

7. The method as claimed in claim 1, further comprising editing the musical score displayed corresponding to the tone information data, wherein the editing of the musical score comprises:

performing a mode shift into a musical score editing mode when editing is selected while the musical score is being displayed;

adjusting a pitch of a tone for a corresponding musical note within the musical score in the musical score editing mode;

changing a duration of a tone for a corresponding musical note within the musical score in the musical score editing mode;

changing a corresponding musical note to a selected musical note within the musical score in the musical score editing mode; and performing a supplementary function for musical score editing in the musical score editing mode.

8. The method as claimed in claim 7, wherein the supplementary function for musical score editing includes block setup, copy, cut, pasting, deleting, and reproduction.

9. A method for outputting a musical score corresponding to audio data, the method comprising:

removing words from audio data and extracting a tone from the wordless audio data while the audio data is being reproduced;

converting the tone into a frequency;

identifying at least one of a monotone and polyphonic tone by analyzing the frequency extracted during a time period, after the time period elapses;

calculating an average value of frequencies extracted during a time period and establishing the average value as a threshold value;

identifying a frequency less than the threshold value as a monotone and converting the corresponding frequency into tone information data;

identifying a frequency equal to or greater than the threshold value as a polyphonic tone and converting the corresponding frequency into tone information data, and storing the tone information data;

displaying a musical score by extracting a musical sign corresponding to the tone information data.

10. The method as claimed in claim 9, wherein the converting of the tone comprises:

quantizing the tone, from which the words have been removed;

extracting pulse code modulation (PCM) data from the quantized data; and converting the PCM data into a frequency through fast Fourier transform (FFT).

11. The method as claimed in claim 9, wherein the displayed musical score includes extracted musical signs corresponding to the tone information data.

12. The method as claimed in claim 9, wherein the tone information data include musical sign information, which comprises musical note information including a pitch of a tone and a duration of the tone, and incidental musical sign information other than the musical note information.

13. The method as claimed in claim 9, further comprising editing the musical score displayed corresponding to the tone information data, wherein the editing of the musical score comprises:

performing a mode shift into a musical score editing mode when editing is selected while the musical score is being displayed;

adjusting a pitch of a tone for a corresponding musical note within the musical score in the musical score editing mode;

changing a duration of a tone for a corresponding musical note within the musical score in the musical score editing mode;

changing a corresponding musical note to a selected musical note within the musical score in the musical score editing mode; and performing a supplementary function for musical score editing in the musical score editing mode.

14. The method as claimed in claim 13, wherein the supplementary function for musical score editing includes block setup, copy, cut, pasting, deleting, and reproduction.

15. A mobile terminal for outputting audio data and musical score image comprising:

a controller comprising a control program for removing words from audio data and extracting a tone from the wordless audio data while the audio data is being reproduced, converting the tone into a frequency, identifying at least one of a monotone and polyphonic tone by analyzing the frequency extracted during a time period, after the time period elapses, calculating an average value of frequencies extracted during a time period and establishing the average value as a threshold value, identifying a frequency less than the threshold value as a monotone and converting the corresponding frequency into tone information data, identifying a frequency equal to or greater than the threshold value as a polyphonic tone and converting the corresponding frequency into tone information data, and extracting a musical sign corresponding to the tone information data;

a memory unit for storing the tone information data; and a display unit for displaying a musical score.

16. The mobile terminal of claim 15, further comprising a multimedia unit for outputting audio data by using the extracted pitch and duration of the tone.

17. The mobile terminal of claim 15, further comprising an image processing unit for converting the photographed musical score into a black-and-white image.

18. The mobile terminal of 15, wherein the control further comprises converting the tones from an analog signal into a digital signal by quantizing the tone, from which the words have been removed, extracting pulse code modulation (PCM) data from the quantized data, and converting the PCM data into a frequency through fast Fourier transform (FFT).

19. The mobile terminal of claim 15, wherein the displayed musical score includes extracted musical signs corresponding to the tone information data.

20. The mobile terminal of claim 15, wherein the tone information data include musical signal information, which comprises musical note information including a pitch of a tone and a duration of the tone, and incidental musical sign information other than the musical note information.

21. A computer-readable recording medium storing a computer program code for outputting a musical score corresponding to audio data, comprising:

a word remover for removing words from audio data;

a tone extractor for extracting a tone from the wordless audio data;

a tone converter for converting the tone into a frequency;

a frequency detector for calculating an average value of frequencies extracted during a time period and establishing the average value as a threshold value, identifying a frequency less than the threshold value as a monotone and converting the corresponding frequency into tone information data and identifying a frequency equal to or greater than the threshold value as a polyphonic tone and converting the corresponding frequency into tone information data; and a display for displaying a musical score corresponding to the tone information data.

* * * * *